United States Patent [19]

Hansen

[11] 4,201,509

[45] May 6, 1980

[54] BACKHOE SWING CYLINDER HYDRAULIC CIRCUIT

[75] Inventor: Charles A. Hansen, Troy, Mich.

[73] Assignee: Ford Motor Company, Dearborn, Mich.

[21] Appl. No.: 948,597

[22] Filed: Oct. 4, 1978

[51] Int. Cl.[2] ..... E02F 3/32; E02F 3/62

[52] U.S. Cl. ..... 414/694; 91/189 A; 212/66

[58] Field of Search ..... 414/687, 694, 695; 212/66; 91/172, 189 R, 189 A

[56] References Cited

U.S. PATENT DOCUMENTS

| | | | |
|---|---|---|---|
| 3,047,171 | 7/1962 | Long | 414/694 |
| 3,530,766 | 9/1970 | Pilch | 414/694 X |
| 3,630,120 | 12/1971 | Carlson et al. | 414/694 X |
| 3,815,766 | 6/1974 | Carlson et al. | 414/694 |
| 4,007,845 | 2/1977 | Worback | 414/687 |
| 4,065,010 | 12/1977 | Worback | 414/694 |
| 4,085,855 | 4/1978 | Worback | 414/694 |
| 4,138,928 | 2/1979 | Pilch | 91/189 X |

*Primary Examiner*—L. J. Paperner
*Attorney, Agent, or Firm*—John J. Roethel; Keith L. Zerschling

[57] ABSTRACT

As the backhoe boom 19 swings into a swing stop, hydraulic fluid is trapped in the head end 28 of the swing side cylinder 24. This trapped fluid is discharged through a cylinder relief valve, thus absorbing the boom kinetic energy and providing a smooth deceleration of the boom. Fluid discharged from the relief valve 47 is routed to the rod end of the swing cylinder and the head end of the opposite cylinder. Because of the swing linkage geometry, the cylinder rod 30 of the other cylinder had passed over the pivot axis about which the backhoe boom was swinging and thus the piston 29 of the other cylinder was caused to move in the same direction as the swing side piston 29. The movement of this piston can be utilized to provide additional deceleration torque as long as no voiding is permitted to occur in the head end of this other cylinder. Voiding only occurs when the backhoe swing control lever 38 is released prior to the backhoe boom reaching the swing stop. Voiding does not occur when the control lever 38 is maintained in a full power-on or is stroked in the power-on mode until the swing stop is contacted. Fluid from the swing side cylinder relief valve is routed to provide the necessary fluid to prevent such voiding. The routing of the fluid from the swing cylinder to the other cylinder assures that the boom deceleration is independent of whether the control lever is stroked or released.

10 Claims, 9 Drawing Figures

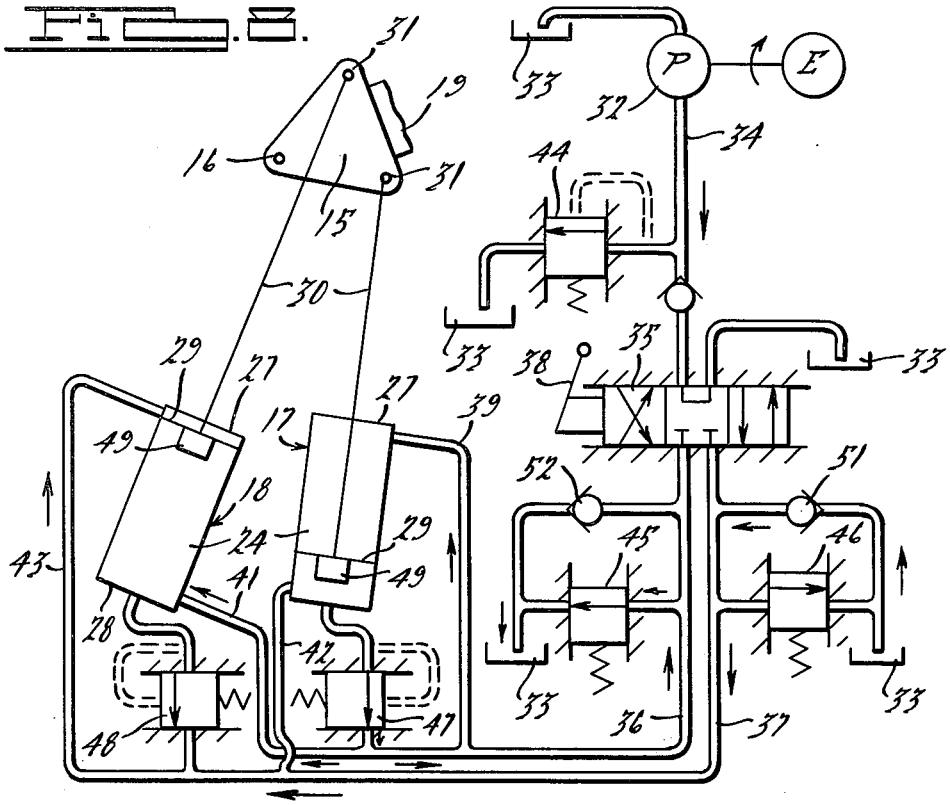
31
19
16
31
15
30
29
27
49
18
24
43
41
28
48
17
27
39
29
49
42
47
33
P
E
32
34
44
33
38
35
33
52
51
45
46
33
36
37
33
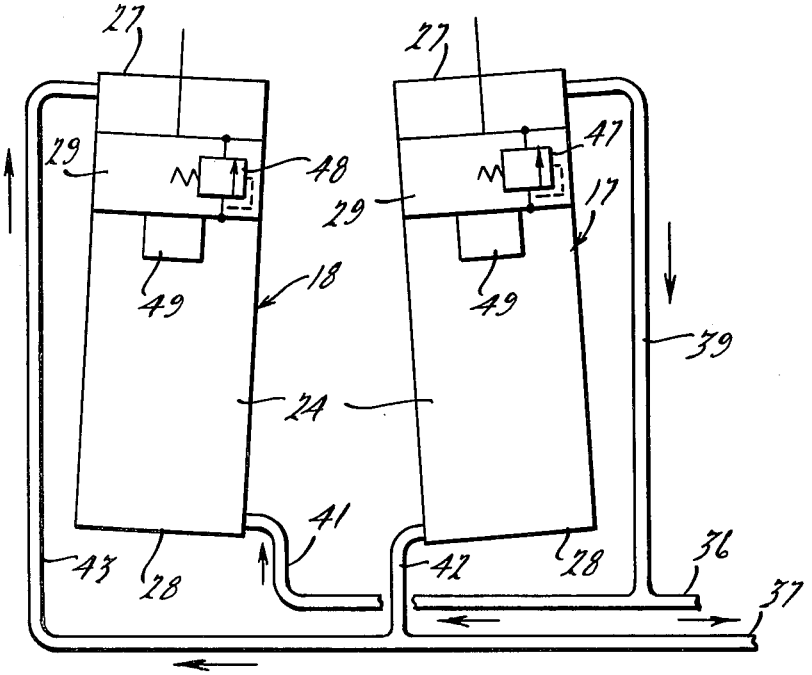
27
29
48
49
18
24
41
43
28
27
47
29
17
49
39
42
28
36
37

BACKHOE SWING CYLINDER HYDRAULIC CIRCUIT

BACKGROUND OF THE INVENTION

In a conventional earth moving machine having an earth digging implement mounted on one end, usually the rear end, the implement, hereinafter referred to as the backhoe, is mounted on a swing post or mast that is supported on the vehicle frame for swinging movement about a vertical axis. The backhoe is swingable from one side to the other of the vehicle about the vertical axis to facilitate the trenching, ditching or other digging operations. The swinging movement is actuated by a pair of pivotally supported hydraulic actuators extending between the vehicle frame structure and the mast or swing post.

One of the earliest patents disclosing a commercially acceptable system for actuating a swing post or mast mounted bucket is U.S. Pat. No. 3,047,171 issued to E. B. Long on July 31, 1962 for a "Swing Mechanism for Backshoe". One feature covered by this patent is that of providing a hydraulic "buffer" or cushioning arrangement that functions to decelerate the rotation or swing of the swing post or mast of the backhoe just prior to the end of its swing. This is accomplished by a dual hydraulic cylinder arrangement in which movement of one of the cylinders over center causes reverse movement of its piston creating a back pressure to check swinging of the swing post or mast. In order to absorb the pressure surge caused by such cushioning, the hydraulic system is provided with a relief valve, the excess pressure fluid being discharged ultimately into the fluid supply reservoir or tank. The hydraulic system also includes directional control valve means for routing fluid under pressure to one or the other of the cylinders, depending on the direction it is desired to swing the backhoe boom.

It apparently was the opinion of persons subsequently active in the development of backhoe control devices that more positive braking or cushioning devices than pressure relief valves were required to control the momentum forces of the heavy backhoe mast and swing units as the end of the swing movement was approached. Reference may be made to U.S. Pat. Nos. 3,630,120 and 3,815,766, both of which issued to Earnest E. Carlson et al. The U.S. Pat. No. 3,630,120 entitled "Swinging Apparatus" was issued Dec. 28, 1971; and the U.S. Pat. No. 3,815,766 entitled "Backhoe Swing Mechanism" was issued June 11, 1974. The Carlson et al patents disclose "sequence valve means for sensing the position of the hydraulic motors or actuators and for directing the flow of fluid to aid in obtaining a relatively constant torque output and angular velocity, bleeder valve means for reducing hydraulic input energy when the pivotal member (mast or swing post) is near the end of its rotation and for maintaining a maximum velocity potential throughout the swing movement, and relief valve means for additionally controlling torque output." The function of Carlson et al's array of valve means is to provide a positive braking or cushioning action not found in the earlier systems, but the result is a valve system believed to be of unnecessary complexity for the benefits derived.

SUMMARY OF THE INVENTION

The present invention relates to a hydraulic system for actuating a swing post mounted backhoe, the swing post being mounted on a vehicle for swinging movement about a vertical axis. The hydraulic system includes a pair of double-acting hydraulic actuators, each of which has a cylinder that is pivotally mounted on a support frame of the vehicle, double acting piston means within the cylinder, and a piston rod extending from the piston means through the rod end of the cylinder to the swing post. The piston rods are pivotally coupled to the swing post on opposite sides of the vertical pivot axis about which the swing post is swingable.

The hydraulic system embodies a hydraulic circuit including a source of pressurized fluid connected to each actuator by a first conduit means communicating with the rod end of one actuator and the head end of the other actuator; and a second conduit means communicating with the head end of one actuator and the rod end of the other actuator. Fluid flow into the system is controlled by a control valve means having an operating member movable from a neutral position to an actuator operating position in which fluid is directed through a predetermined one of a conduit means to the rod end of one of the actuator cylinders and to the head end of the other actuator cylinder to cause the swing post to swing in a predetermined direction. The pressure of the fluid acting on the actuator cylinders causes the piston end of one actuator cylinder to move from the rod end toward the head end. Simultaneously, the piston of the other cylinder is caused to move from the head end toward the rod end until the other cylinder piston rod crosses over the swing post pivot axis to the same side of the latter as the piston rod of the one actuator cylinder. As a result of this over-center movement, the direction of movement of the piston of the other cylinder reverses and both pistons move from the rod ends toward the head ends of their respective cylinders. The system also includes a cutoff means operative to prevent discharge of fluid from the head end of the one actuator cylinder as the swing post approaches a predetermined position relative to the end of its side swing movement.

The improvement embodied in the present invention comprises a relief means for by-passing the cutoff means to permit controlled discharge of fluid trapped in the one actuator cylinder head end to cushion the deceleration of the swing post. The fluid from the relief means is routed through the one conduit means to the head end of the other cylinder, whereby the other cylinder provides additional deceleration torque as long as no voiding occurs therein in the event the control valve means operating member is returned to a neutral position before the swing post reaches the end of its side movement. The fluid supplied from the head end of the one actuator cylinder provides the necessary volume of fluid to the other cylinder to prevent such voiding from occurring.

DESCRIPTION OF THE DRAWINGS

The invention will be described, by way of example, with reference to the drawings in which:

FIGS. 7 and 8 are diagrammatic views of the hydraulic circuit in an operating mode in which the swing post has been swung over center and the power to the actuators has been released by return of the control lever of the control valve to a neutral position, the momentum of the boom continuing the movement of the swing post toward the swing stop; and FIG. 9 is a diagrammatic view of a second embodiment of the present invention in which the cylinder relief valves are integrated with the hydraulic actuator pistons, rather than being integrated with the head end of the cylinders, as shown in FIGS. 4–8, inclusive.

DETAILED DESCRIPTION OF THE INVENTION

Figure 1:
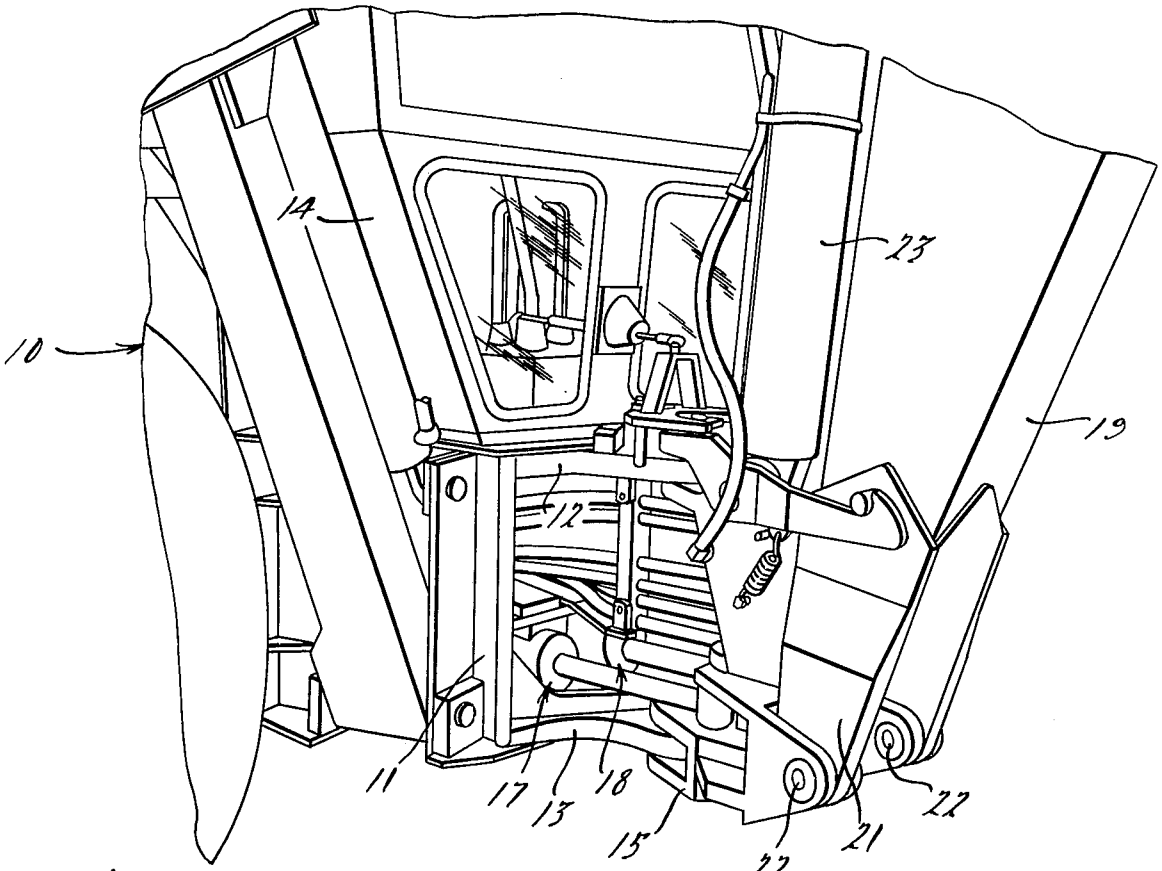
FIG. 1 is a perspective view of a portion of an earth moving machine having a mast or swing post mounted backhoe on one end of the vehicle, the mast or swing post being shown in a centered position.
Figure 2:
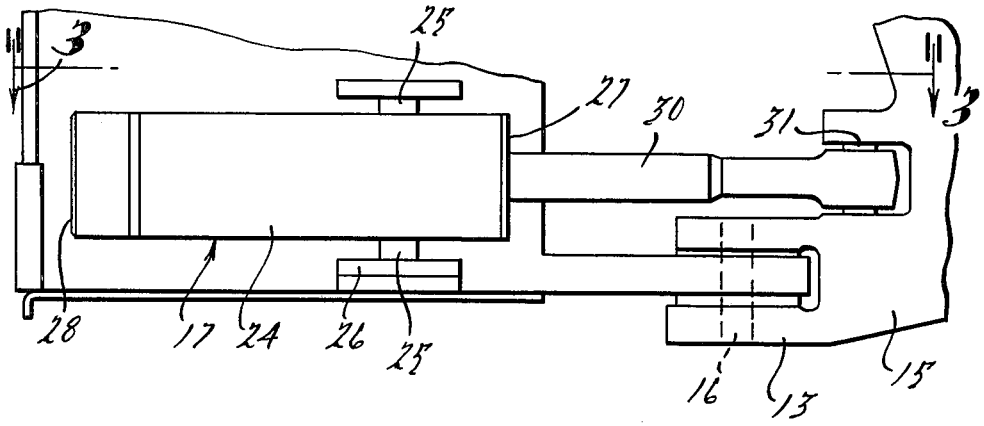
FIG. 2 is a side elevation of a hydraulic actuator showing its relationship to the mast or swing post.
Figure 3:
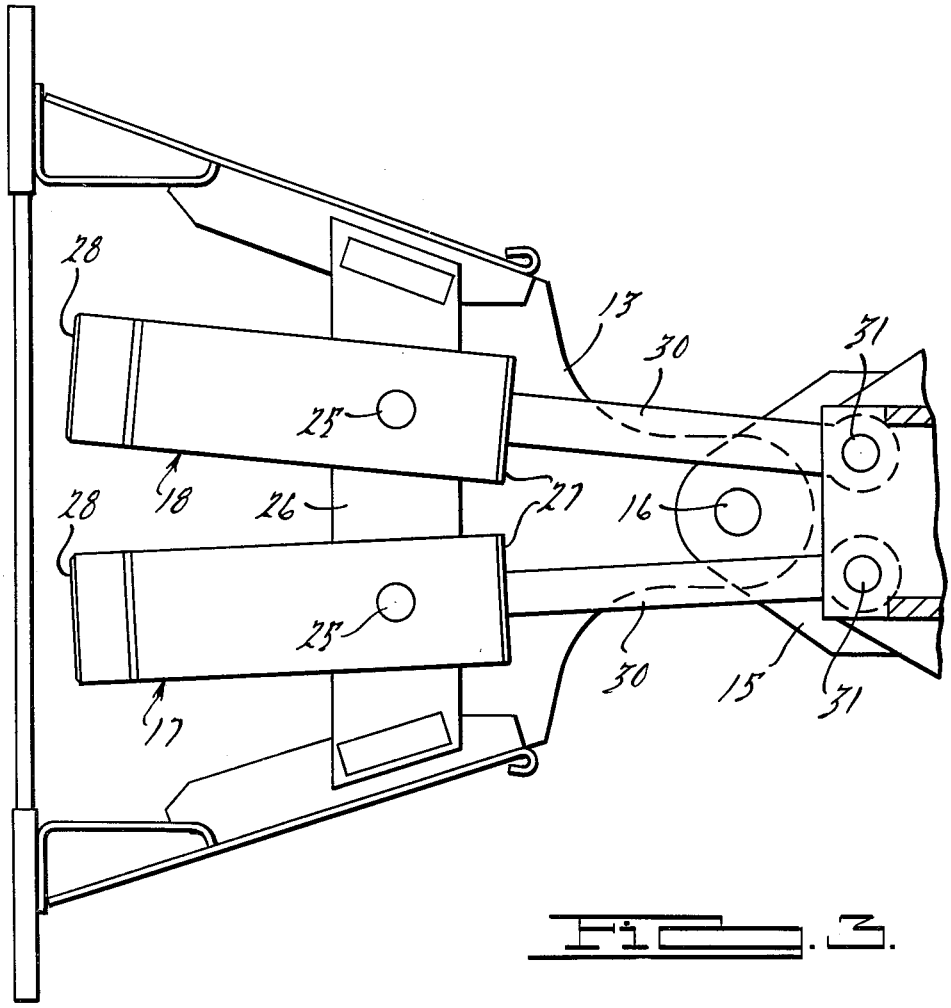
FIG. 3 is a view taken substantially in the direction of the arrows 3—3 in FIG. 2.

Referring now to the drawings, and more particularly to FIGS. 1, 2 and 3, there is partially shown one end of an earth moving machine, generally designated 10, adapted to have an earth working implement or backhoe mounted thereon. The earth moving machine 10 has an end frame structure 11 having upper and lower horizontal flanges 12 and 13 extending rearwardly away from the vehicle operator's cab 14.

A swing post or mast 15 is pivotally mounted on the flanges 12 and 13 on pivot shafts 16, as best seen in FIGS. 2 and 3. The pivot shafts 16 are vertically aligned to provide a vertical pivot axis about which the swing post 15 is horizontal swingable from side to side as may be required during the trenching, ditching or other digging operations being undertaken. The swing post 15 is swingable in either direction by a pair of hydraulic actuators 17–18 located beneath the operator's cab. A boom 19 is supported at its inner or lower end 21 on horizontally aligned pivot pins 22 journalled in the swing post 15. The boom is swingable from a fully raised position, as shown in FIG. 1, to a lowered position by a hydraulic ram 23.

Each hydraulic actuator 17–18 comprises a cylinder 24 pivotally mounted on suitable pivot devices 25 journalled in support members 26 in the space beneath the operator station. The pivot axis of each cylinder 25 is located approximately one-fourth of the length of the cylinder forwardly of the rod end 27 of the cylinder, that is, toward the head end 28. This location is a matter of design choice and has been selected to give optimum swing linkage geometry and swing torque.

Each cylinder 24 contains a double-acting piston 29 (see FIG. 4) and has a piston rod 30 extending from the piston through the rod end of the cylinder toward the swing post or mast 15. The piston rods 30 of the respective hydraulic actuators 17–18 are pivotally coupled by pivot devices 31 to the swing post rearwardly of the vertical pivot axis defined by the swing post pivots 16 and on opposite sides of the latter. The swing post or mast 15 is shown in a neutral or centered position with both hydraulic actuators 17–18 having their piston rods 30 equally extended.

Figure 4:
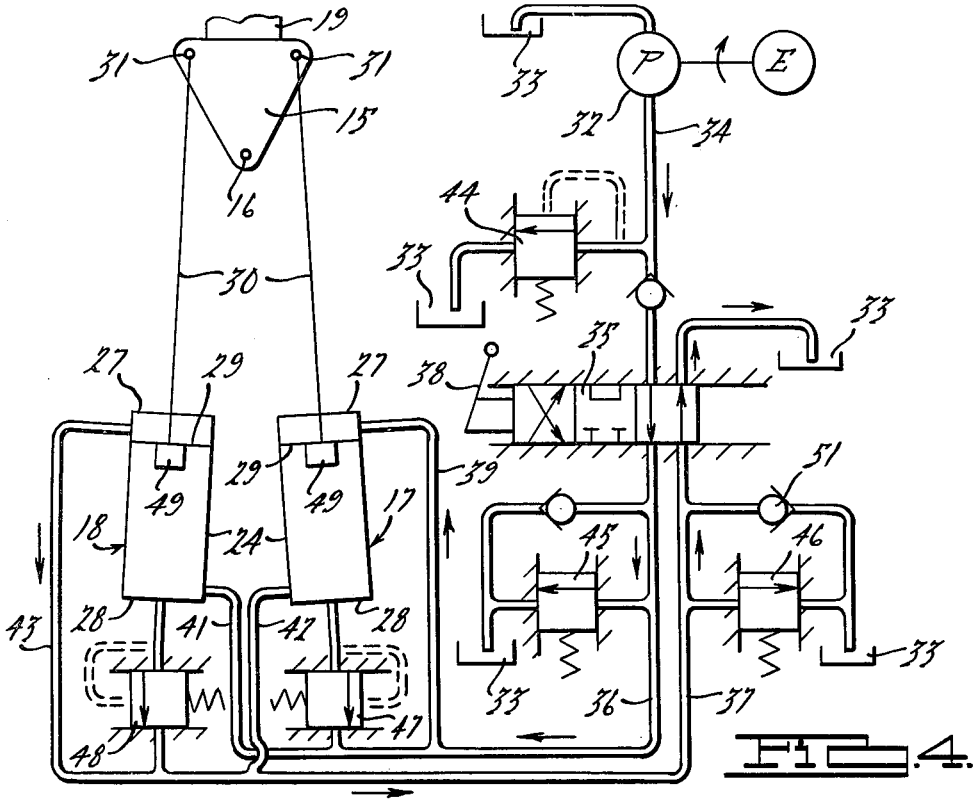
FIGS. 4, 5 and 6 are diagrammatic views of the hydraulic circuit showing the swing post in a sequence of positions beginning in the neutral or centered position and then ending up in a decelerating mode with full power on as the swing post swing stop is approached.

With further reference to FIG. 4, the hydraulic circuitry for controlling and motivating the hydraulic actuators 17–18 includes a source of fluid under pressure comprising an engine driven pump 32 adapted to draw hydraulic fluid from a tank or reservoir 33 and to discharge the fluid of predetermined pressure and discharge rate into a conduit 34 in communication with a control valve 35 operable to direct the pressurized fluid into a first conduit 36 or a second conduit 37. The control valve 35 is operated by a control valve lever 38, and depending on the operator's manipulation of this lever, the swing post or mast 15 and the boom mounted thereon may be swung in either a clockwise or a counter-clockwise direction, as viewed in FIG. 4. For the purpose of this description, it will be assumed the operator desires to swing the swing post or mast 15 in a clockwise direction. Accordingly, the control valve will be operated to direct pressurized fluid into conduit 36 and the conduit 37 then becomes the return line for the fluid in the system.

The conduit means 36 has a first branch 39 in communication with the rod end 27 of the hydraulic actuator 17 and a second branch 41 in communication with the head end 28 of the hydraulic actuator 18. The second conduit 37 has a first branch 42 in communication with the head end 28 of the hydraulic actuator 17 and a second branch 43 in communication with the rod end 27 of the actuator 18. This is conventional practice in the use of dual hydraulic actuators in backhoes and hydraulic steering systems for articulated vehicles or for the landing gear of aircraft. With this arrangement, the swing side actuator, the one on the side of the swing post pivot axis toward which the swing post is moving, is assisted by the other actuator, as will be more fully explained. Since, for the purposes of explanation, it is being assumed the swing post 15 is swinging in a clockwise direction toward the hydraulic actuator 17, the latter will hereinafter on occasion be referred to as the swing side actuator and the actuator 18 as the other side actuator.

A plurality of relief valves and check valves are shown. For example, a system relief valve 44 is shown between the pump 32 and the control valve 35 which has the function of relieving pressure on the discharge side of the pump when there is no flow through the control valve. Each conduit 36 and 37 is provided with a circuit relief valve 45 and 46, respectively, to relieve pressure in these conduits should it be necessary.

In addition to the relief valves 44, 45 and 46, the hydraulic system emboding the present invention utilizes two additional relief valves 47 and 48. These valves are physically integrated in the head ends 28 of the cylinders 24 of the hydraulic actuators 17 and 18, respectively. The valves 47 and 48 are adapted through suitable conduits to communicate the head ends of the cylinders 24 of the actuators 17 and 18 directly with the conduits 36 and 37, respectively, for functional purposes to be explained.

As has been stated, the swing post or mast 15 carrying the boom 19 is shown in a neutral or centered position and the assumption is that the backhoe operator is to swing the same in a clockwise direction. This is accomplished by moving the control lever 38 of the control valve 35 in a direction to permit fluid flow from the pump 32 to the conduit 36. Fluid under pressure will flow through the conduit 36 through its branch 39 to the rod end 27 of the swing cylinder 24, in the present instance the cylinder of the hydraulic actuator 17. Fluid will flow simultaneously through conduit 36, branch 41, to the head end 28 of the other cylinder 24, the cylinder of the hydraulic actuator 18. The result of the fluid pressure being exerted on the rod end side of the piston 29 of the hydraulic actuator 17 causes this piston to move toward the head end of its cylinder. This retracts the swing side piston rod 30 into the swing side cylinder and pulls the swing post 15 in the desired clockwise direction. This movement is being assisted by the hydraulic actuator 18 which is receiving fluid into the head end of its cylinder, thereby causing movement of its piston towards the head end and extension of its piston rod outwardly to exert a pushing force in a clockwise direction on the swing post 15. Because of the geometry of the system, the swing side piston and the piston rod coupled to it begin to move rapidly toward the head end of the swing cylinder, while the piston and piston rod of the other cylinder are moving very slowly since the piston has only a short distance to go before reaching the rod end of the other cylinder.

During the movement of the swing cylinder piston toward the head end 28 of the cylinder of the hydraulic actuator 17, fluid is being discharged from the head end through the branch 42 of the conduit 37. Fluid simultaneously is being discharged from the head end of the cylinder of the hydraulic actuator 18 into the branch conduit 43. The fluid from the branches 42 and 43 are then discharged through the conduit 37 and the control valve 35 back to the tank or reservoir 33.

Figure 5:
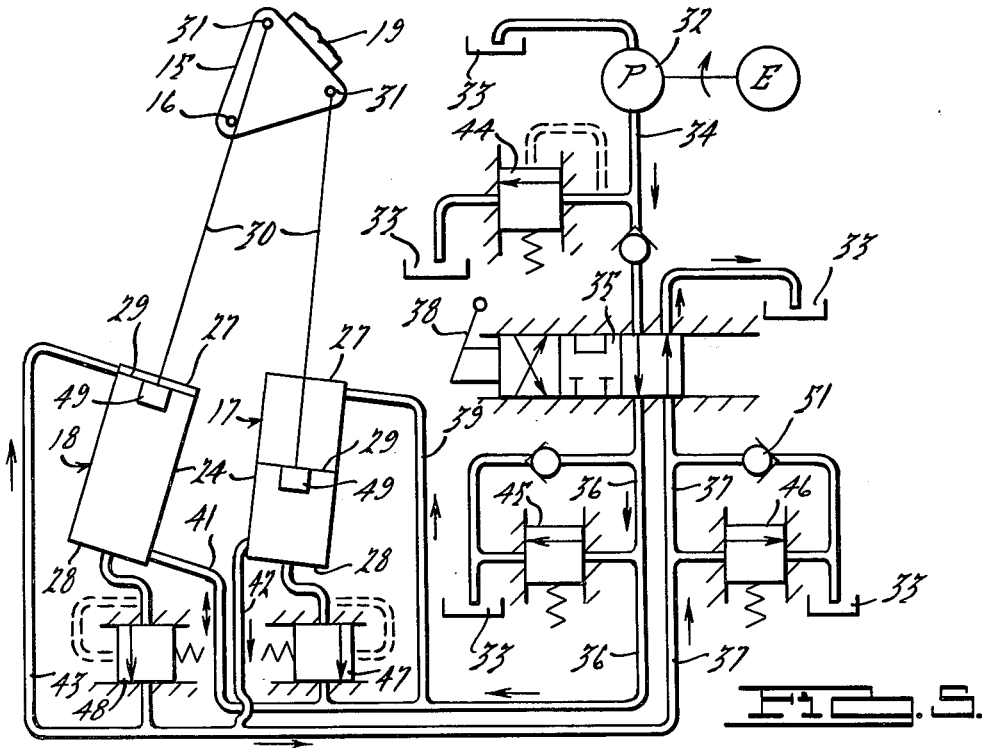

FIG. 5 diagramatically illustrates a further phase of the power-on swinging movement of the swing post. By power-on is meant that the control lever 38 is in a position so that the fluid under pressure from the pump 32 is being directed into the conduit 36 through the control valve 35. In the further phase, the piston 29 of the hydraulic actuator 17 is rapidly moving toward the head end of its cylinder. The piston 29 of the hydraulic actuator 18 which had been moving toward the rod end of its cylinder reverses its direction of movement as its piston rod 30 crosses over the pivot axis 16 of the swing post. That is, the piston 29 begins to move toward the head end 28 of the cylinder 24 of the hydraulic actuator 18.

As the piston 29 of the hydraulic actuator 17 approaches the end of its movement towards the head end of its cylinder, a cut-off means comes into play. This cut-off means is diagrammatically shown as a projection 49 beneath the piston which represents a plunger that plugs the exhaust line leading from the head end of the cylinder. This is conventional practice for this type of hydraulic cylinder mechanism and in the present instance would result in the inlet to the conduit 42 being blocked so that fluid cannot flow through the conduit 42 into the return line 37.

Figure 6:
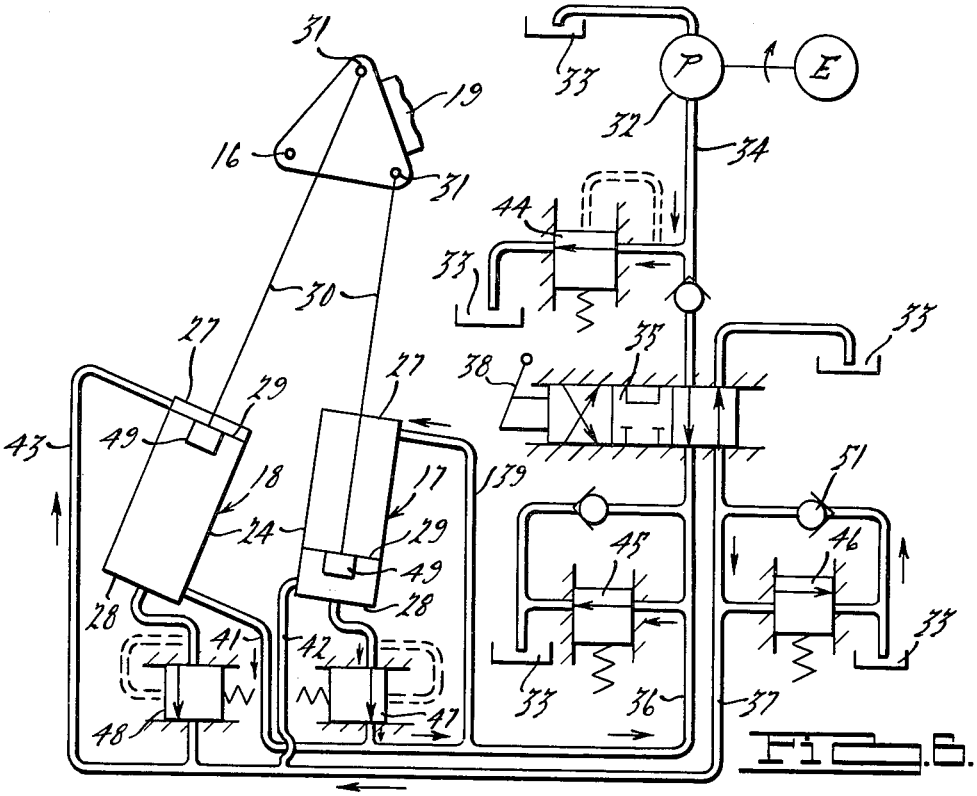

With reference to FIG. 6, this then becomes the concluding or deceleration phase of the power-on movement of the swing post. The blockage of the discharge from the head end of the hydraulic actuator 17 occurs approximately twenty degrees before the swing post reaches a point at which it is mechanically stopped by abutting a swing stop. As a result of the momentum of the swing post because of its weight and the weight of the boom, swing post movement continues during the last twenty degrees causing a pressure build-up to occur in the head end of the hydraulic actuator 17. At a predetermined point or pressure build-up, the cylinder relief valve 47 opens to relieve this pressure and to permit a controlled deceleration of the swing post. This controlled deceleration preferably should be assisted by the resistance to movement of the piston of the hydraulic actuator 18 toward the head end of the cylinder of the latter.

When the relief valve 47 opens, there is a reversal of flow of fluid in the conduit 36 and its branch conduit 41. Some of the fluid from the head end of the cylinder 24 of the hydraulic actuator 18 and from the head end of the cylinder 24 of the hydraulic actuator 17 will attempt to flow through the conduit 39 into the rod end of the cylinder 24 of the hydraulic actuator 17, but the volume demand of this cylinder will be drastically cut since the movement of the piston rapidly slows down as the end of the swing of the swing post is approached. Accordingly, excess fluid from the head ends of the respective cylinders and fluid coming from the control valve will be discharged through the circuit relief valve 45 where it will be returned to the tank or reservoir 33. Since the piston 29 of the cylinder 24 of the hydraulic actuator 18 is moving away from its rod end, it will create a suction on the system, particularly on the branch conduit 43 of the conduit 37. This suction may result in fluid being drawn from the tank or reservoir 33 through the control valve 35.

Preferably, the backhoe operator should stroke or fully return the control lever 38 toward its neutral position during the period in which the fluid from the head end of the swing cylinder is blocked from discharging into the return line 37, thus providing a controlled deceleration as the swing post approaches the end of its stroke. But, even if the operator maintains full power-on to the end of the stroke, the present system permits adequate fluid deceleration because of the co-action between the two hydraulic actuator cylinders 17 and 18.

Figure 7:
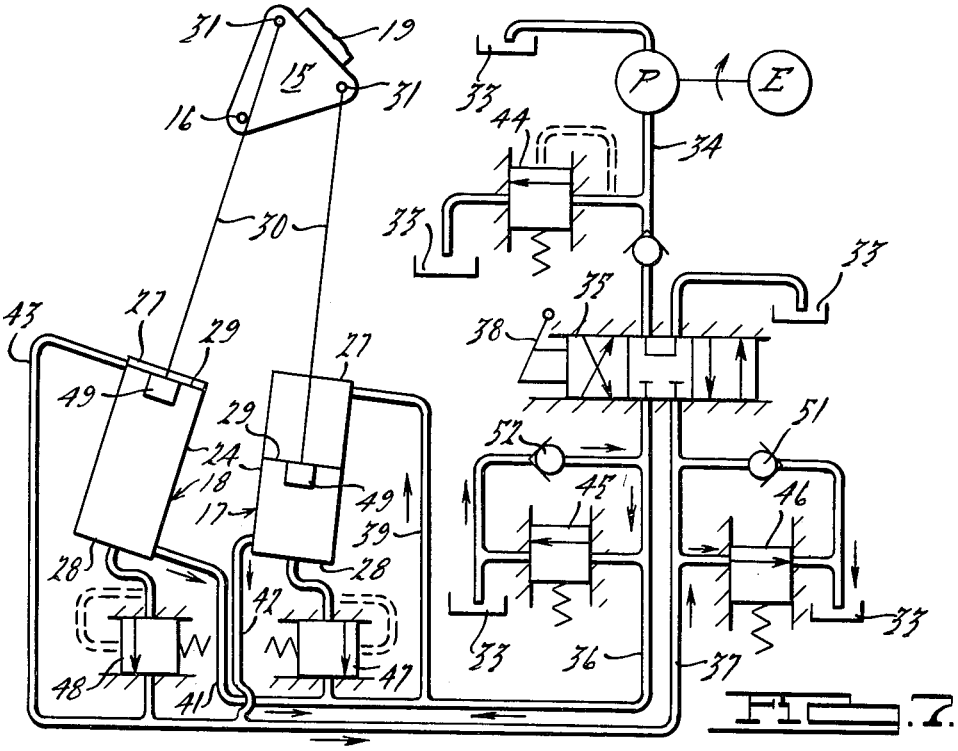

The present system differs from earlier known systems in that the cylinder relief valve 47 does not discharge directly to a sump. Instead, it discharges into the line that had been supplying fluid to the rod end of the cylinder 24 of the hydraulic actuator 17. Because of this arrangement, the co-action between the two hydraulic actuators to decelerate the swing post as it moves toward its swing stop cannot be disrupted by premature return of the control lever 38 to its neutral position, even though the movement of the swing post and the boom have not been stopped and the movement of the piston continues as a result of the momentum of the swing post and boom. Reference is made to FIGS. 7 and 8 for a more detailed explanation of this feature of the present invention.

FIG. 7 is substantially a physical duplicate of FIG. 5 in that it shows the swing post 15 in a position in which the piston rod 30 of the hydraulic actuator 18 has just crossed over the pivot axis 16 of the swing post. Since it is now assumed, however, that the backhoe operator has released the control lever 38 which has returned to a neutral position cutting off the flow of fluid under pressure from the pump 32 through the control valve 35, and, further, that the momentum of the boom 19 and swing post 15 causes the latter to continue to swing in a clockwise direction toward the swing stop, the fluid flow conditions within the system on the discharge side of the control valve 35 are substantially different in FIG. 7 from that related with respect to FIG. 5.

The momentum of the swing post 15 and boom 19 drives the piston 29 and piston rod 30 of the hydraulic actuator 17 from the rod end towards the head end of the cylinder 24 of the hydraulic actuator 17. As the piston 29 moves toward the head end, it creates a suction on the branch 39 of conduit 36. Although the piston 29 of the hydraulic actuator 18 now is moving from the rod end toward the head end of the cylinder 24 of the hydraulic actuator 18, its rate of movement is substantially slower than that of the piston 29 of the hydraulic actuator 17. The result of the disparity of movement of the pistons in the hydraulic actuators 17 and 18 is such that the piston in the hydraulic actuator 17 functions as a pump pulling fluid from the head end of the hydraulic actuator 18 through the branch conduit 41 and also from the tank or reservoir 33 through the check valve 52 in communication with the conduit 36.

While the foregoing is occurring, fluid is being discharged from the head end of the hydraulic actuator 17 cylinder through the branch line 42 of the conduit 37. Some of this fluid is being supplied to the conduit 43 leading to the rod end of the hydraulic actuator 18 cylinder. The quantity of fluid required to fill the void in the rod end of the hydraulic actuator 18 cylinder above the slowly moving piston 29 of the latter, is much less than that being discharged from the hydraulic actuator 17 cylinder. Therefore, the remainder of the discharge fluid flows through the conduit 37 through the circuit relief valve 46 back to the tank or reservoir 33. It should be apparent, however, that a condition now is occurring in the head end of the hydraulic actuator 18 cylinder which would cause a void in the latter. This void, if permitted to exist, could have a negative effect on the ability of the system to provide the desired deceleration torque as the swing post and boom approach the end of their travel.

In the present system, fluid from the swing side cylinder, the cylinder of the hydraulic actuator 17, provides the necessary fluid to prevent voiding in the head end of the other cylinder, i.e., the cylinder of the hydraulic actuator 18. Reference is made to FIG. 8 for the manner in which this is accomplished.

FIG. 8 corresponds physically to FIG. 6 in that the swing side cylinder piston 29 is indicated as having reached the point in its travel from the rod end to the head end of the cylinder 24 of the hydraulic actuator 17 in which discharge from the head end is cut off by the cut-off means diagrammatically illustrated at 49. The result is that the pressure in the head end of the hydraulic actuator 17 cylinder builds up to a point at which the relief valve 47 is forced to open and to discharge high pressure fluid into the conduit 36. Some of this high pressure fluid will flow through the branch conduit 41 to the head end of the hydraulic actuator 18 cylinder, this preventing the undesirable occurrence of a void in the cylinder. Some of the fluid in the conduit 36 will flow to the branch conduit 39 into the rod end of the hydraulic actuator 17 cylinder. All excess fluid in the conduit 36 has an outlet through the circuit relief valve 45 from which it can return to the tank or reservoir 33.

The downward movement of the piston 29 of the hydraulic actuator 18 will place the branch 43 of the conduit 37 under suction and since no fluid is available from branch 42 leading to the discharge side of the hydraulic actuator 17 cylinder, make-up fluid will be obtained through the check valve 51 in communication with the conduit 37 and the tank or reservoir 33.

The reason that voiding did not occur in the hydraulic actuator 18 cylinder under the FIG. 5 conditions of operation, i.e., the conditions when the swing post and boom are moved toward the swing stop under power, as occurs when the control lever 38 is held in an on position or is stroked toward the on position, is that the pressure in the conduit 36 is sufficient to reverse the flow in the conduit branch 41 in the event that there is any tendency for voiding to occur in the hydraulic actuator 18 cylinder. For this reason, the flow arrows in FIG. 5 are shown as indicating fluid flowing in either direction. Under FIG. 8 conditions, however, if the relief valve 47 discharged into a conduit leading back to the tank or reservoir 33, as in earlier conventional systems, the only direction that fluid could flow from the hydraulic actuator 18 cylinder would be in a discharge direction from the head end of the cylinder. This would create the undesired voiding problem and would reduce the effectiveness of the hydraulic actuator 18 to assist in providing the desired deceleration torque.

It should be understood, that if the swing post movement was originally started in a counter-clockwise direction, the roles played by the hydraulic actuators 17 and 18 would be reversed. The hydraulic actuator 18 would become the active actuator and the hydraulic actuator 17 would become what might be considered the passive actuator. The resultant flow of fluid through the system would be a mirror image of that which has been described on the basis of clockwise movement of the swing post and boom.

FIG. 9 of the drawings illustrates the modification in which the relief valves corresponding to the relief valves 47 and 48 of the previously described embodiment are integrated with the pistons 29, rather than being located in or coupled to the head end of the cylinder 24 of each hydraulic actuator. This construction and arrangement also is effective to prevent voiding in the hydraulic actuator opposite the swing side hydraulic actuator. For example, if the swing side hydraulic actuator is the hydraulic actuator 17 as in the previously described embodiment, the voiding that might occur in the hydraulic actuator 18 as a result of the control lever 38 being released prior to the backhoe boom reaching the swing stop is automatically compensated. To illustrate, if the piston in the hydraulic actuator 17 cylinder approaches the head end of the cylinder so as to permit the cut-off device 49 to become operative to cut off discharge of fluid from the head end into the branch conduit 42, the pressure in the head end will build up to a point that the relief valve 47 will open, permitting flow through the piston into the rod end of the hydraulic actuator 17 cylinder. The fluid then will flow from the rod end of the cylinder into the branch conduit 39, into the conduit 36 and ultimately the branch conduit 41, thereby supplying fluid to the head end of the hydraulic actuator 18 cylinder and preventing any voiding from occurring in the latter that would otherwise result if no fluid was being supplied to the rod end of the hydraulic actuator 17 cylinder.

It is to be understood this invention is not limited to the exact constructions illustrated and described above, but that various changes and modifications may be made without departing from the spirit and scope of the invention as defined by the following claims.

I claim:

1. A hydraulic system for actuating a swing post mounted backhoe, the swing post being mounted on a vehicle for swinging movement about a vertical axis, the hydraulic system including a pair of double acting hydraulic actuators each of which has a cylinder that is pivotally mounted on a support frame of the vehicle, double acting piston means within the cylinder, and a piston rod extending from the piston means through the rod end of the cylinder to the swing post, the piston rods being pivotally coupled to the swing post on opposite sides of the vertical pivot axis about which the swing post is swingable, a hydraulic circuit including a source of pressurized fluid connected to each actuator by a first conduit means communicating with the rod end of one actuator and the head end of the other actuator, and a second conduit means communicating with the head end of the one actuator and the rod end of the other actuator, control valve means having an operating member movable from a neutral position to an actuator operating position in which fluid is directed through a predetermined one of the conduit means to the rod end of one of the actuator cylinders and to the head end of the other actuator cylinder to cause the swing post to swing in a predetermined direction, the pressure of the fluid acting on the actuator cylinders causing the piston in the one actuator cylinder to move from the rod end toward the head end and the piston of the other cylinder to move from the head end toward the rod end until the other cylinder piston rod crosses over the swing post pivot axis to the same side of the latter as the piston rod of the one actuator cylinder whereupon the direction of movement of the piston of the other cylinder reverses and both pistons move from the rod ends toward the head ends of their respective cylinders, and cut-off means operative to prevent discharge of fluid from the head end of the one actuator cylinder as the swing post approaches a predetermined position relative to the end of its side swing movement, wherein the improvement comprises:

relief means bypassing the cut-off means to permit controlled discharge of fluid trapped in the one actuator cylinder head end to cushion the deceleration of the swing post, the fluid from the relief means being routed through the one conduit means to the head end of the other cylinder whereby the other cylinder provides additional deceleration torque as long as no voiding occurs therein in the event the control valve means operating member is returned to a neutral position before the swing post reaches the end of its side movement, the fluid from the head end of the one actuator cylinder providing the necessary volume of fluid to the other cylinder to prevent voiding.

2. A hydraulic system for actuating a swing post mounted backhoe according to claim 1, in which:

the relationship of the pivotal connection of the hydraulic actuators to the vehicle frame and the swing post being such that the piston of the one actuator cylinder moves toward the head end of its cylinder substantially faster than the piston of the other actuator cylinder moves to the head end of its cylinder whereby return of the operating member to its neutral position prior to the completion of the swing post swinging movement cuts off pressurized fluid to the conduit means and results in the continued movement of the one actuator cylinder piston toward the head end of its cylinder by the momentum of the swinging backhoe, the movement of the one actuator cylinder piston creating a negative pressure in the conduit means and a reverse flow of fluid from the other actuator cylinder and a void in the cylinder between its piston and head end.

3. A hydraulic system for actuating a swing post mounted backhoe according to claim 1, in which the relief means for each hydraulic actuator communicates the head end of the one actuator cylinder with the first conduit means, and the head end of the other actuator cylinder with the second conduit means.

4. A hydraulic system for actuating a swing post mounted backhoe according to claim 1, in which:

the relief means for each hydraulic actuator communicates the rod end and head end of each actuator cylinder through the piston means.

5. A hydraulic system for actuating a swing post mounted backhoe according to claims 3 or 4, in which:

the relationship of the pivotal connection of the hydraulic actuators to the vehicle frame and the swing post being such that the piston of the one actuator cylinder moves toward the head end of its cylinder substantially faster than the piston of the other actuator cylinder moves to the head end of its cylinder whereby return of the operating member to its neutral position prior to the completion of the swing post swinging movement cuts off pressurized fluid to the conduit means and results in the continued movement of the one actuator cylinder piston toward the head end of its cylinder by the momentum of the swinging backhoe, the movement of the one actuator cylinder piston creating a negative pressure in the conduit means and a reverse flow of fluid from the other actuator cylinder and a void in the cylinder between its piston and head end.

6. A hydraulic system for actuating a swing post supporting a backhoe boom on a vehicle for swinging movement about a vertical pivot axis, comprising:

a dual hydraulic actuator means for swinging the swing post and thereby the boom mounted thereon to one side or the other of the vehicle toward respective swing stops, each actuator means having a cylinder pivotally mounted on a frame member of the vehicle, a piston within the cylinder, and piston rod means extending from the cylinder and pivotally coupled to the swing post, the piston rod means extending longitudinally of the vehicle and lying on opposite sides of the pivot axis of the swing post when the boom is positioned centrally of the vehicle, conduit means communicating the rod end of each cylinder with the head end of the other cylinder, a source of fluid under pressure, and control valve means having an operating member movable from a neutral position for directing the fluid through the conduit means simultaneously to the rod end of the swing side cylinder, i.e, the cylinder on the side of the swing post pivot axis toward which the boom is to be swung, and to the head end of the other cylinder, the fluid pressure causing the swing side cylinder piston to move from the rod end toward the head end of the swing side cylinder, and the opposite cylinder piston to move from the head end toward the rod end of the opposite cylinder until the opposite cylinder piston rod crosses over the swing post pivot axis whereby the direction of movement of the opposite cylinder piston is reversed and both pistons move in the same direction from the rod ends toward the head ends of the respective cylinders, and cut-off means operative to prevent discharge of fluid from the head end of the swing side cylinder as the swing post approaches a predetermined position relative to the swing side swing stop, wherein the improvement comprises:

relief means bypassing the cut-off means to permit controlled discharge of fluid trapped in the swing side cylinder head end to cushion the deceleration of the swing post after the latter passes through the predetermined position, and further conduit means routing the fluid from the relief means to the rod end of the swing side cylinder and to the head end of the other cylinder whereby the other cylinder provides additional deceleration torque as long as no voiding occurs therein upon the control valve means being returned to neutral before the swing post abuts its swing stop, the fluid from the head end of the swing side cylinder providing the necessary volume of fluid to the other cylinder to prevent voiding.

7. A hydraulic system for actuating a swing post mounted backhoe according to claim 6, in which:

the relationship of the pivotal connection of the hydraulic actuators to the vehicle frame and the swing post being such that the piston of the one actuator cylinder moves toward the head end of its cylinder substantially faster than the piston of the other actuator cylinder moves to the head end of its cylinder whereby return of the operating member to its neutral position prior to the completion of the swing post swinging movement cuts off pressurized fluid to the conduit means and results in the continued movement of the one actuator cylinder piston toward the head end of its cylinder by the momentum of the swinging backhoe, the movement of the one actuator cylinder piston creating a negative pressure in the conduit means and a reverse flow of fluid from the other actuator cylinder and a void in the cylinder between its piston and head end.

8. A hydraulic system for actuating a swing post mounted backhoe according to claim 6, in which:

the relief means for each hydraulic actuator communicates the head end of the one actuator cylinder with the first conduit means and the head end of the other actuator cylinder with the second conduit means.

9. A hydraulic system for actuating a swing post mounted backhoe according to claim 6, in which:

the relief means for each hydraulic actuator communicates the rod end and head end of each actuator cylinder through the piston means.

10. A hydraulic system for actuating a swing post mounted backhoe according to claims 7 or 8, in which:

the relationship of the pivotal connection of the hydraulic actuators to the vehicle frame and the swing post being such that the piston of the one actuator cylinder moves toward the head end of its cylinder substantially faster than the piston of the other actuator cylinder moves to the head end of its cylinder whereby return of the operating member to its neutral position prior to the completion of the swing post swinging movement cuts off pressurized fluid to the conduit means and results in the continued movement of the one actuator cylinder piston toward the head end of its cylinder by the momentum of the swinging backhoe, the movement of the one actuator cylinder piston creating a negative pressure in the conduit means and a reverse flow of fluid from the other actuator cylinder and a void in the cylinder between its piston and head end.

* * * * *